United States Patent [19]

von Blücher et al.

[11] Patent Number: 4,554,198

[45] Date of Patent: Nov. 19, 1985

[54] WATERPROOF AND AIR-TIGHT, MOISTURE-CONDUCTING TEXTILE MATERIAL

[76] Inventors: Hubert von Blücher, Freytagstrasse 45; Hasso von Blücher, Sohnstrasse 58, both of D-4000 Düsseldorf; Ernest de Ruiter, Hohenstrasse 57a, D-5000 Leverkusen all of Fed. Rep. of Germany

[21] Appl. No.: 716,900

[22] Filed: Mar. 28, 1985

Related U.S. Application Data

[63] Continuation-in-part of Ser. No. 454,389, Dec. 29, 1982, abandoned.

[30] Foreign Application Priority Data

Jan. 14, 1982 [DE] Fed. Rep. of Germany ..... 3200942

[51] Int. Cl.[4] ..... A41D 13/00; A62B 17/00; B05D 5/00; B32B 5/24

[52] U.S. Cl. ..... 428/143; 2/2; 427/246; 428/242; 428/244; 428/315.5; 428/315.9; 428/317.9; 428/423.1; 428/904

[58] Field of Search ..... 427/246; 428/242, 244, 428/143, 315.5, 315.9, 317.9, 423.1, 904; 2/2

[56] References Cited

U.S. PATENT DOCUMENTS

| | | | |
|---|---|---|---|
| 3,029,166 | 4/1962 | Hainsworth et al. . | |
| 3,486,968 | 12/1969 | Mater | 428/315.5 |
| 3,538,020 | 11/1970 | Heskett et al. . | |
| 3,645,775 | 2/1972 | Schulze et al. | 428/315.5 |
| 3,663,266 | 5/1972 | Dye | 428/315.5 |
| 3,772,059 | 11/1973 | Shikada | 428/315.5 |
| 3,922,470 | 11/1975 | Amano et al. | 428/315.5 |
| 4,045,609 | 8/1977 | Hart . | |
| 4,190,696 | 2/1980 | Hart et al. . | |
| 4,429,000 | 1/1984 | Naka et al. . | |

FOREIGN PATENT DOCUMENTS

| | | | |
|---|---|---|---|
| 134968 | 4/1979 | German Democratic Rep. | 428/315.5 |
| 2039790 | 8/1980 | United Kingdom | 428/315.5 |

*Primary Examiner*—James C. Cannon

*Attorney, Agent, or Firm*—Sprung, Horn, Kramer & Woods

[57] ABSTRACT

The invention relates to a waterproof and air-tight, moisture-conducting textile material (1) which has a coating (3) of coagulated polyurethane containing preferably a great number of micropores, and which has a water vapor permeability of more than 5000 g/m$^2$ in 24 hours.

6 Claims, 3 Drawing Figures

WATERPROOF AND AIR-TIGHT, MOISTURE-CONDUCTING TEXTILE MATERIAL

Figure 1:
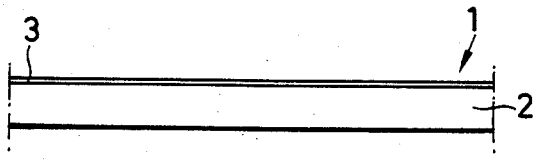

This application is a continuation-in-part of application Ser. No. 454,389, filed Dec. 29, 1982, now abandoned.

BACKGROUND OF THE INVENTION

Textile materials are used in protective clothing for civil and/or military purposes or for tarpaulins and the like. An important characteristic of the textile materials used for such purposes is their tightness whereby they are resistant to the penetration both of dust and of moisture, depending on the purpose for which they are used. When textile materials are used in making protective clothing, provision must be made so that the moisture produced by the body is carried away. The most effective way of getting rid of excess body heat is, in human beings, the evaporation of moisture, which normally takes place on the skin, which at the same time remains dry. This mechanism is operative, however, only when the moisture can be carried away. Consequently, the ability of clothing to allow moisture to pass through it is important to the well-being of the wearer. Normally this property of clothing is achieved by a more or less high permeability to air, and this has led to the erroneous idea of "breathing", because the skin does not really breathe, but merely has to yield moisture to the atmosphere.

Particularly in the field of protective clothing, such as clothing for protection against weather, or work clothing, or clothing for military purposes, but also in the recreational sector, in the case, for example, of anoraks, tents, sleeping bags etc., there is a need, on the one hand, for a sufficient permeability to water vapor, but on the other hand, these materials must also have a more or less pronounced ability to seal out water.

It is the object of the invention to make available a textile material which is waterproof, but at the same time is capable of accumulating and transporting a considerable amount of moisture and passing it off in the form of water vapor, and which also has some specific protective quality for certain purposes, such as protection against chemical warfare agents, bacteria or radiation, for example.

The moisture accumulating ability of a textile material is especially desired where the production of moisture is not uniform over a period of time. Consequently, the textile material must be able to serve as a buffer to absorb a short-term overproduction of moisture which cannot be carried to the exterior fast enough. It is also important that this buffering action, which promotes the comfort of the wearer, be achieved in combination with moisture transport in such a way that the material will be able to satisfy stringent mechanical strength requirements.

This object is achieved in accordance with the invention by a waterproof moisture-conducting textile material which has a coating of coagulated polyurethane containing a very large number of micropores and consequently has a permeability to water vapor of more than 5,000 g/m$^2$ in 24 hours. The micropores have a diameter of 1–10 $\mu$m, preferably 2–4 $\mu$m, their volume amounts from 20 to 70% of the polyurethane coating. The corresponding density of the coating being 0,3 to 0,8 g/cc. The water vapor permeability preferably attains ratings of 5,000 to 20,000 grams per square meter per day, depending on the thickness of the coating, which as a rule amounts to 50 to 200 micrometers, especially approximately 100 micrometers.

The storing action that is already present due to the microporous structure of the coating can be improved by embedding of so-called absorbent bodies based on cellulose.

The textile support can have the structure of a woven or knit cloth, but also it can be a nonwoven fabric. It can consist, for example, of natural fibers such as cotton, wool or silk, but it can also consist of synthetic fibers on the basis of polyesters, polyamides, polyacrylonitrile, aramides, or even mineral fibers such as glass, or carbon fibers. It it not essential that the textile support be water-repellent or absorbent. What is important is whether it is permeable to water vapor. In the case of a very dense material which has no more than a low permeability to air, the inherent absorbency of the fibers can contribute to this, while a water-repellent textile support should be sufficiently open to be adequately permeable to water vapor.

The textile material can also be a woven or knit fabric treated for fire retardancy, or a fabric made with yarns treated in this manner. The coagulated polyurethane is applied preferably in a thin coating to the textile supprt material, and the waterproof quality can be improved by the admixture of water-repellent agents such as silicones, or by copolymerizing or coagulating such agents together with the polyurethane. The water-tightness can also be further increased by subsequent hydrophobation.

A textile material coated with coagulated polyurethane is outstandingly suitable for use for protection against rain, dust, NBC weapons etc., and finds application, for example, in protective clothing. The textile material of the invention can be used as protective cloth also in articles of heavy-duty clothing, such as air-sea rescue clothing for pilots or persons who have to perform strenuous work. Here the high water vapor permeability combined with sufficient water-proofness is of especial value, for it permits the wearer to carry on his normal activity without appreciable additional annoyance due, for example, to moisture build-up.

Since the coating of coagulated polyurethane is very suitable as a support for a variety of substances having a specific protective quality, the textile material of the invention can also be applied to other special uses. For example, by the incorporation of active carbon into the polyurethane an outstanding protection against chemicals can be achieved. Substances such as alumina trihydrate $Al(OH)_3$, incorporated into the polyurethane coating, protect against the so-called heat flash of an atomic bomb explosion. To improve the fire-retardancy of the materials of the invention, the polyurethane can contain an admixture, for example, of antimony trioxide and decabromodiphenylether, for the use of a material of the invention for protection against radiation, lead sulfate, for example, is a suitable additive.

Other substances having specific protective qualities can also be incorporated into the polyurethane coating or applied to the surface thereof, depending on the intended purpose of the textile material.

In accordance with another aspect of the invention, the coating material is pre-coagulated.

By way of background, when a textile coated with a 10%–20% solution of polyurethane in dimethylformamide (DMF) is dipped in water, the water-soluble DMF migrates into the water while water simultaneously penetrates into the layer of polyurethane and DMF. The resulting dilution of the solvent precipitates the polyurethane and produces a microporous sponge that is in and of itself known, as in making synthetic leather such as Corfam.

It is apparent, especially when the coatings are thicker, that coagulation proceeds differently in the outer and inner layers (more slowly in the inner) and that a less porous skin forms. This causes water-vapor permeability, etc., to deteriorate.

These drawbacks can to some extent be avoided by precoagulating the DMF solution, applying it, and finally completely coagulating it. In precoagulation only a (small) part of the polyurethane is coagulated, resulting in a non-homogeneous mass consisting of coagulated particles (the polyurethane sponge already having formed here) suspended in the polyurethane solution. These porous particles cause much more uniform coagulation. There are commercially available polyurethane dispersions (e.g., Desmoderm KPC and KBA) which are especially useful for precoagulation. They are introduced into the DMF-polyurethane solution in up to about 10%.

If the active-carbon particles are stirred directly into the DMF-polyurethane solution, a separate precoagulation will no longer be necessary because the particles, which contain about 30% moisture, effect precoagulation in their vicinity. On the other hand, if the active carbon is not applied until after the polyurethane-DMF solution has been spread on (but before final coagulation), it is an advantage to precoagulate with the aforesaid dispersions.

Figure 2:
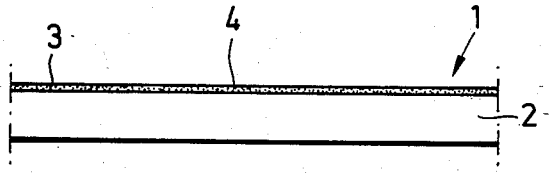
Figure 3:
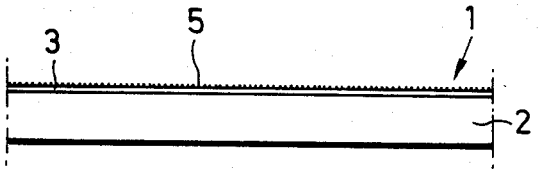

The invention will be further described with reference to the accompanying drawing wherein FIGS. 1, 2 and 3 are schematic side elevations of three different textile materials in accordance with the invention.

Although FIG. 1 of the drawing represents a textile material 1 of the invention which consists only of a textile support 2 and a thin coating 3 of coagulated polyurethane modified with silicones applied thereto, the textile material in FIG. 2 differs in that finely granular active carbon 4 is embedded in the polyurethane coating 3. FIG. 3 shows another embodiment of a textile material of the invention in which finely granular aluminum hydroxide 5 has been applied to the polyurethane coating 3.

The invention will be further described in the following illustrative examples wherein all parts are by weight unless otherwise expressed:

EXAMPLES

EXAMPLE 1

12 parts of a polyurethane dispersion (Desmoderm KBA) are stirred into a coating material consisting of 15 parts of polyurethane (Desmoderm KWC) and 85 parts of DMF and allowed to stand 24 hours. About 10% of the polyurethane precoagulates. A woven nylon fabric weighing 140 g/m$^2$ is coated with this precoagulated material. The DMF is then washed out of the coating in a bath, so that the remaining polyurethane coagulates. The structure is then dried. The microporous polyurethane coating has a weight of about 70 g/m$^2$. Then the material thus prepared was thoroughly impregnated with a perchlorethylene solution of a fluorocarbon compound (FC 905 of 3 M-Company), dried and cross-linked. The water vapor permeability of the textile material was approximately 8000 g/m$^2$/24 h, while the impermeability to water corresponded to a water column of more than 1500 millimeters. The textile material thus prepared is outstandingly suitable for use as a raincoat material with excellent wearing characteristics.

EXAMPLE 2

A precoagulated coating material was prepared as in Example 1. 5% by weight of fine-grained $Al(OH)_3$ and 1.5% by weight of Caliban P-45 flameproofing agent (White Chemical) were also then stirred in.

A flame-retarding 150 g/m$^2$ cotton fabric was coated with this material and the web washed, dried, and impregnated as in Example 1. The resulting material was watertight, had good clothing physiology properties, and also offered satisfactory protection against heat flash.

EXAMPLE 3

The cotton fabric described in Example 2 was coated with the same precoagulated material. Immediately after application particles of active carbon (spherical particles 0.3–0.5 mm in diameter), were dusted onto the coating and lightly pressed into the surface. The web was then washed, dried, and impregnated as in Example 1. 115 g/m$^2$ of active carbon were accordingly made to adhere. Aside from the properties mentioned with reference to Example 2, the resulting material also offered satisfactory protection against chemical-warfare materials.

In a another run, similar properties were achieved with a Nomex fabric. The precoagulation, however, was carried out by addition of only 4 parts of Desmoderm KBA.

EXAMPLE 4

21 parts of active carbon containing 30% moisture (=about 15 parts dry carbon), 95% with a particle size less than or equal to 4 μm and 5% from 6–15 μm, were stirred into a coating material consisting of 15 parts polyurethane (Desmoderm KCW) and 100 parts DMF. The material was then allowed to stand for 24 hours. Since the moisture in the active carbon caused precoagulation in the vicinity of its particles, no more was needed. The precoagulated material was then applied to 100 g/m$^2$ Nomex. The coated fabric was conveyed through a bath to wash out the DMF, with most of the polyurethane coagulating. The material was then dried. The microporous coating of about 300 g/m$^2$ consisted of a thorough mixture of coagulated polyurethane and particles of active carbon.

This material also exhibited satisfactory protection against chemical weapons.

EXAMPLE 5

A precoagulated coating material was prepared by dissolving 25 parts of Desmoderm KCW and 25 parts of Desmoderm KBH in 100 parts of DMF. 8 parts of Desmoderm KPC and 12 parts of Desmoderm KBA were stirred into this solution with a turbine agitator for purposes of precoagulation. The material was allowed to stand for 24 hours and became cloudy. About 20% of all the polyurethane precoagulated.

A 140 g/m$^2$ nylon fabric was coated with precoagulated material, which had been diluted to a solids content of 15%. Most of the polyurethane was coagulated by washing out the DMF, and the material was dried.

The coating weighed 38 g/m$^2$ and its water-vapor permeability was more than 7000 g/m$^2$/24 hours.

It will be appreciated that the instant specification and examples are set forth by way of illustration and not limitation, and that various modifications and changes may be made without departing from the spirit and scope of the present invention.

We claim:

1. A textile material produced by coating a textile fabric with a dispersion in a solvent of a pre-coagulated polyurethane, removing the solvent to complete coagulation of the polyurethane, and drying to form a coating having a large number of micropores, the textile material having a water vapor permeability of 5,000 to 20,000 g/m$^2$,24 h.

2. A textile material according to claim 1, wherein additional protective agents are supported by the polyurethane.

3. A textile material according to claim 1, carrying active carbon particles in the polyurethane.

4. A textile material according to claim 1, wherein the coating is modified by silicones.

5. A textile material according to claim 1, in the form of an article of protective clothing.

6. A textile material according to claim 1, in the form of a tarpaulin.

* * * * *